US011595750B2

(12) United States Patent
Cho et al.

(10) Patent No.: US 11,595,750 B2
(45) Date of Patent: Feb. 28, 2023

(54) MULTI-RANGE SPEAKER CONTAINING MULTIPLE DIAPHRAGMS

(71) Applicant: Resonado, Inc., South Bend, IN (US)

(72) Inventors: Leeg Hyun Cho, Yongin-si (KR); Youngil Cho, Chicago, IL (US); Christian Femrite, Westminster, CO (US)

(73) Assignee: Resonado, Inc., Chicago, IL (US)

( * ) Notice: Subject to any disclaimer, the term of this patent is extended or adjusted under 35 U.S.C. 154(b) by 0 days.

(21) Appl. No.: 17/458,064

(22) Filed: Aug. 26, 2021

(65) Prior Publication Data

US 2021/0392429 A1 Dec. 16, 2021

Related U.S. Application Data

(63) Continuation of application No. 16/659,389, filed on Oct. 21, 2019, now Pat. No. 11,134,333.

(60) Provisional application No. 62/809,866, filed on Feb. 25, 2019.

(51) Int. Cl.

| | |
|---|---|
| ***H04R 1/24*** | (2006.01) |
| ***H04R 7/16*** | (2006.01) |
| ***H04R 9/02*** | (2006.01) |
| ***H04R 9/04*** | (2006.01) |
| ***H04R 9/06*** | (2006.01) |
| ***H04R 3/00*** | (2006.01) |
| ***H04R 1/02*** | (2006.01) |
| ***H04R 7/12*** | (2006.01) |

(52) U.S. Cl.

CPC ..... *H04R 1/24* (2013.01); *H04R 1/02* (2013.01); *H04R 3/00* (2013.01); *H04R 7/127* (2013.01); *H04R 7/16* (2013.01); *H04R 9/025* (2013.01); *H04R 9/04* (2013.01); *H04R 9/045* (2013.01); *H04R 9/06* (2013.01); *H04R 2400/11* (2013.01)

(58) Field of Classification Search

None

See application file for complete search history.

(56) References Cited

U.S. PATENT DOCUMENTS

| | | | |
|---|---|---|---|
| 4,856,071 | A | 8/1989 | Marquiss |
| 7,502,486 | B2 | 3/2009 | Shin |
| 2005/0220320 | A1 | 10/2005 | Kim |
| 2007/0139151 | A1 | 6/2007 | Nussbaum |
| 2007/0165887 | A1 | 7/2007 | Shin |
| 2007/0286439 | A1 | 12/2007 | Salehi |
| 2011/0044489 | A1 | 2/2011 | Saiki et al. |
| 2012/0148074 | A1 | 6/2012 | Bastiaens |

(Continued)

FOREIGN PATENT DOCUMENTS

| | | |
|---|---|---|
| GB | 1 045 807 A | 10/1966 |
| JP | 2001-054191 | 2/2001 |

(Continued)

*Primary Examiner* — Kenny H Truong

(74) *Attorney, Agent, or Firm* — DLA Piper LLP (US)

(57) ABSTRACT

Embodiments are disclosed of a speaker capable of producing multi-frequency-range sound using bar magnets, multiple diaphragms, and a shared planar voice coil. The planar voice coil is located between the bar magnets and translates a received electric signal into the kinetic energy that vibrates the diaphragms, thus reproducing multi-frequency range sound. In some embodiments, the speaker generates bi-directional sound.

16 Claims, 11 Drawing Sheets

(56) References Cited

U.S. PATENT DOCUMENTS

| | | | | |
|---|---|---|---|---|
| 2014/0161303 | A1 | 6/2014 | Kim | |
| 2015/0010195 | A1 | 1/2015 | Croft, III | |
| 2015/0373461 | A1* | 12/2015 | Andersson | H04R 25/606<br>600/25 |
| 2016/0205479 | A1 | 7/2016 | Tomar et al. | |
| 2016/0373862 | A1 | 12/2016 | Yoon et al. | |

FOREIGN PATENT DOCUMENTS

| | | | |
|---|---|---|---|
| JP | 2014-517594 | | 7/2014 |
| KR | 101425912 | B1 | 8/2014 |
| KR | 2017 0112611 | A | 10/2017 |
| WO | 2018 096761 | A1 | 5/2018 |

* cited by examiner

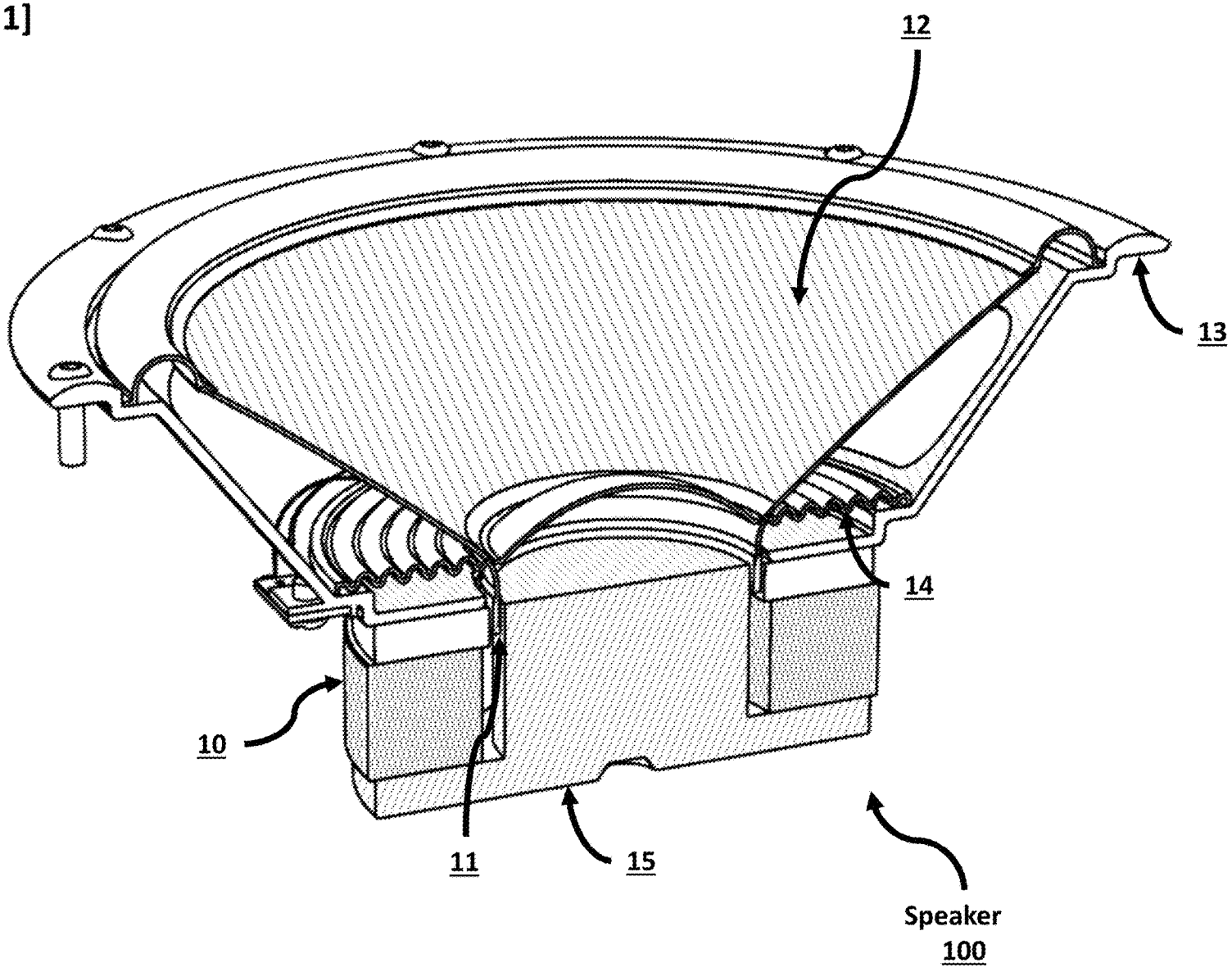
[Fig. 1]

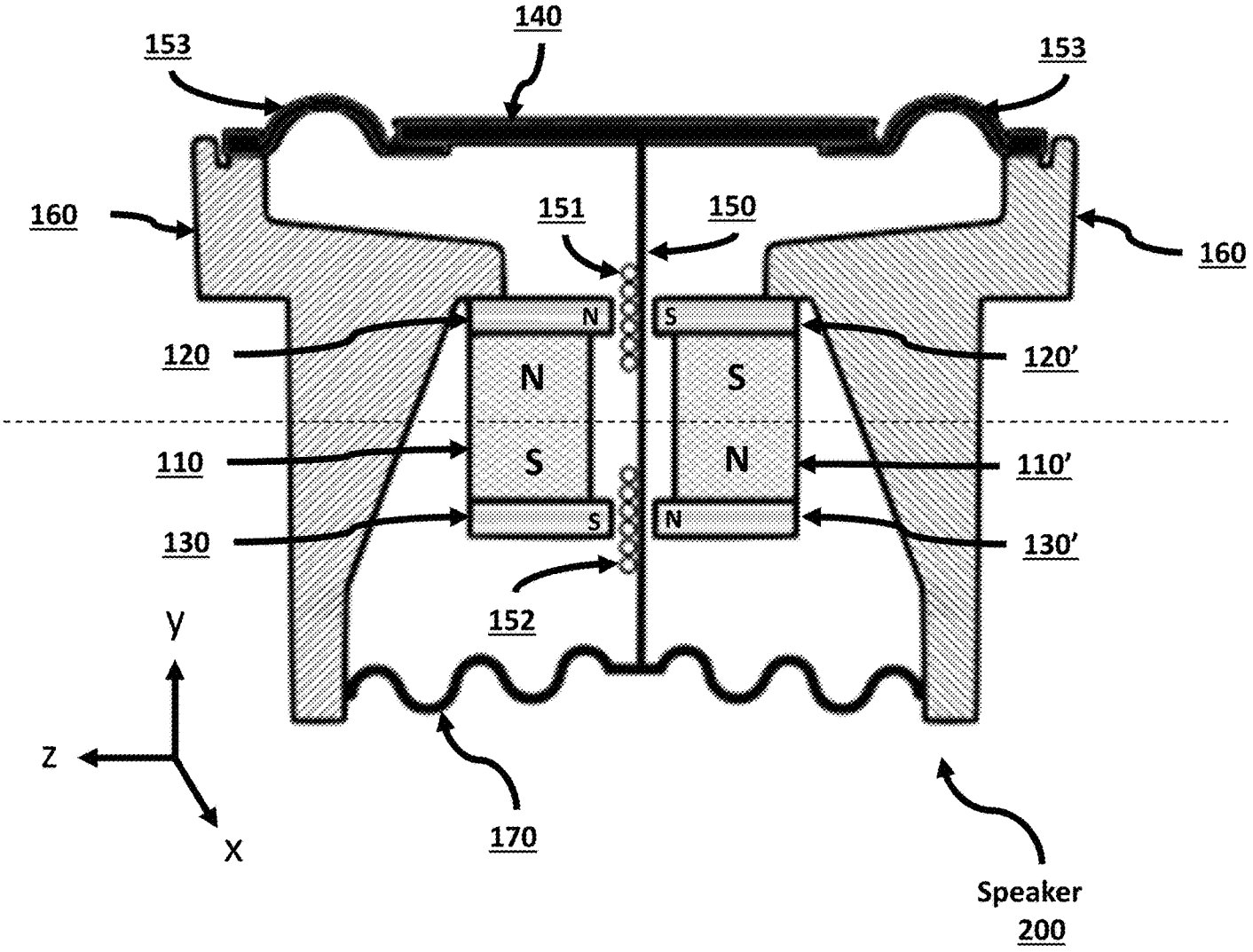
[Fig. 2]

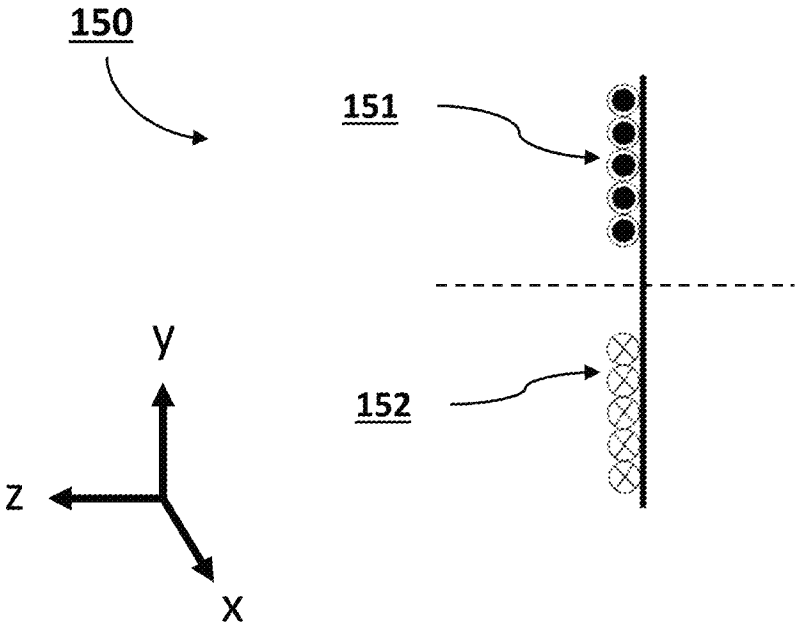
[Fig. 3a]

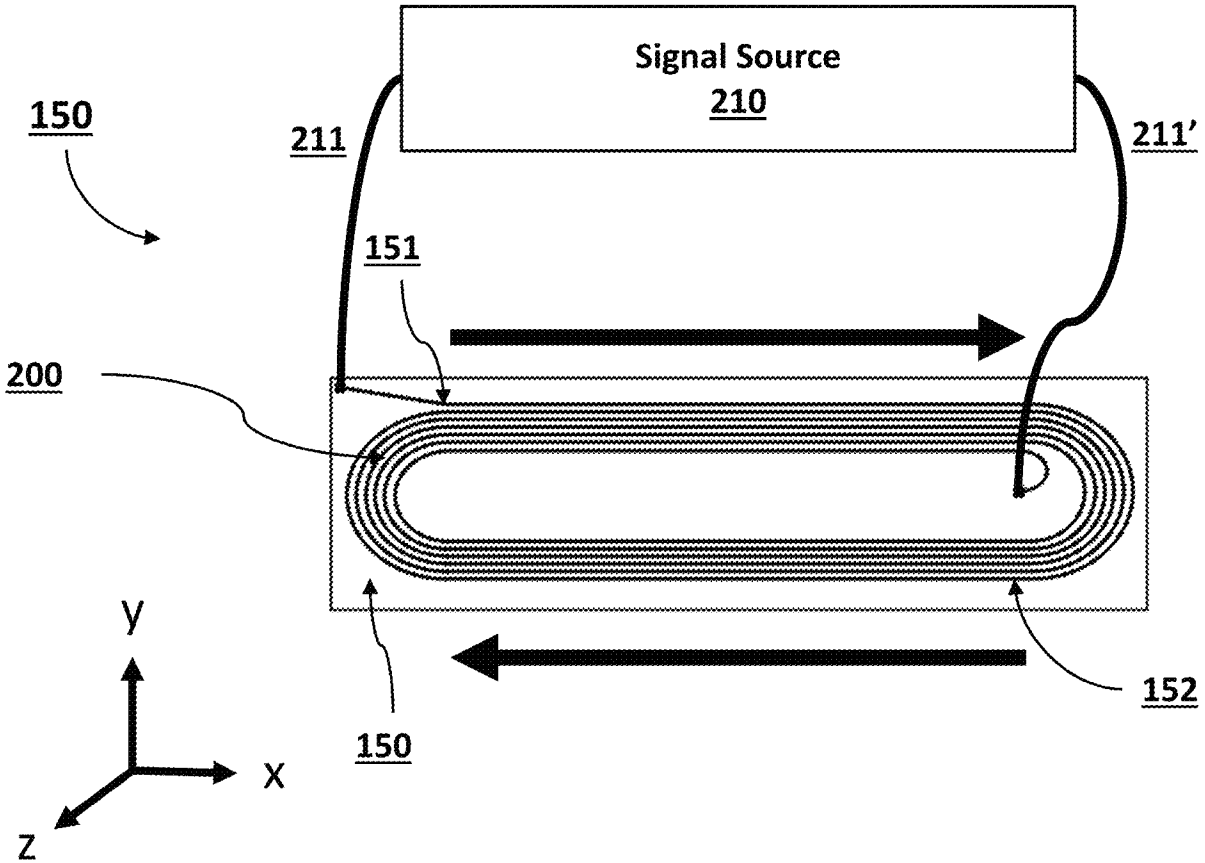
[Fig. 3b]

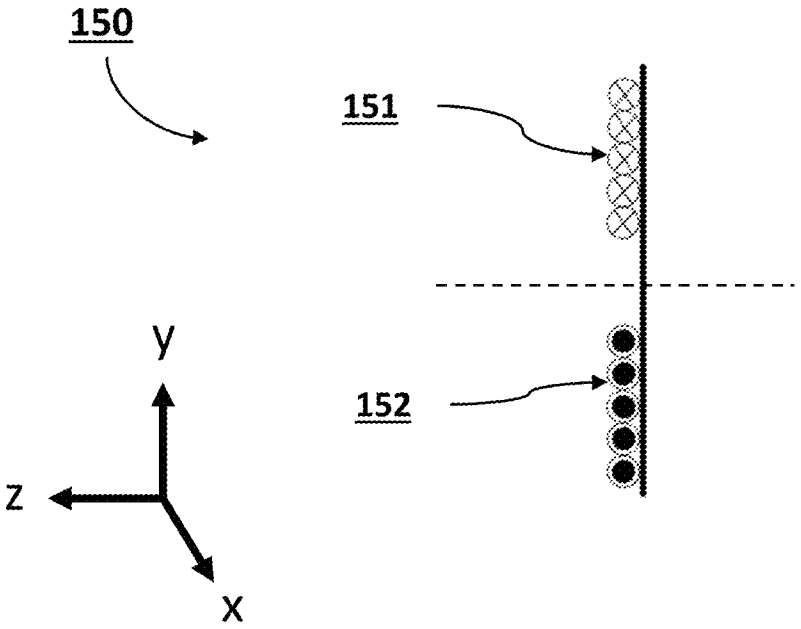
[Fig. 3c]

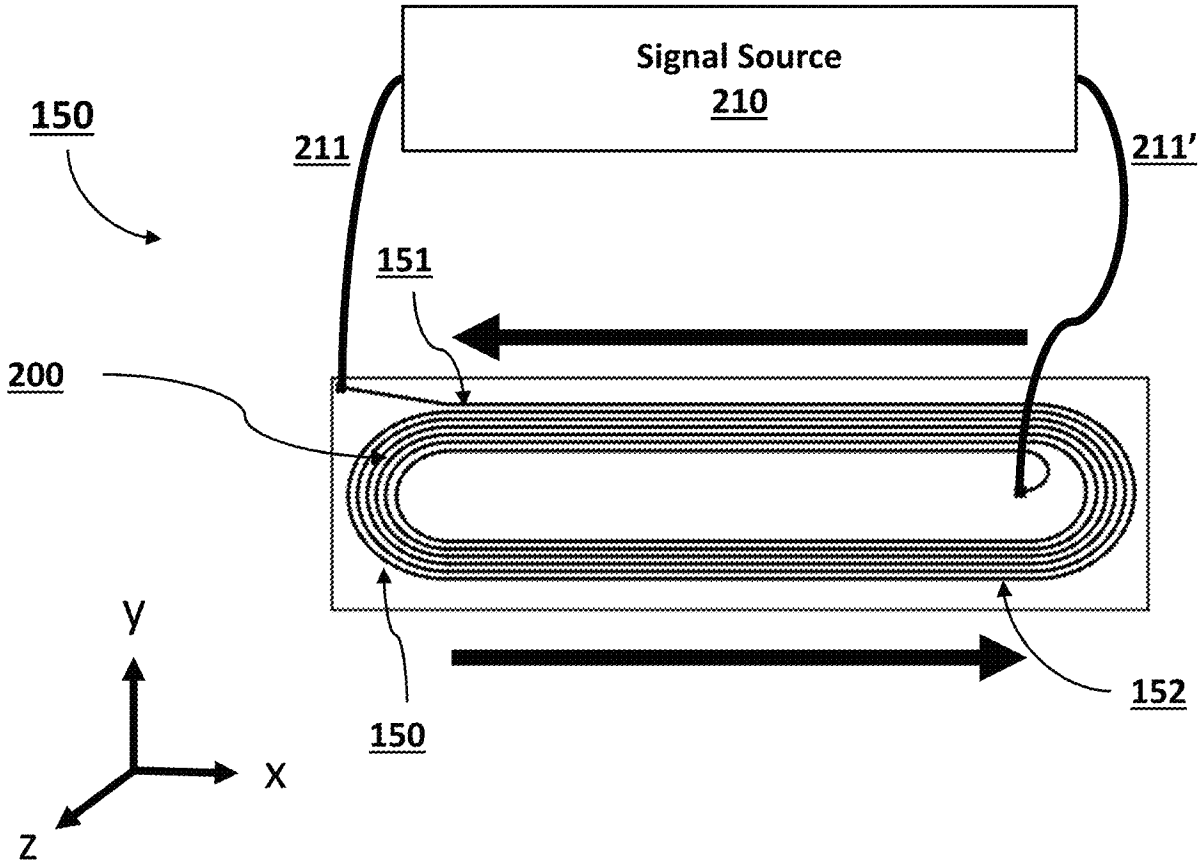
[Fig. 3d]

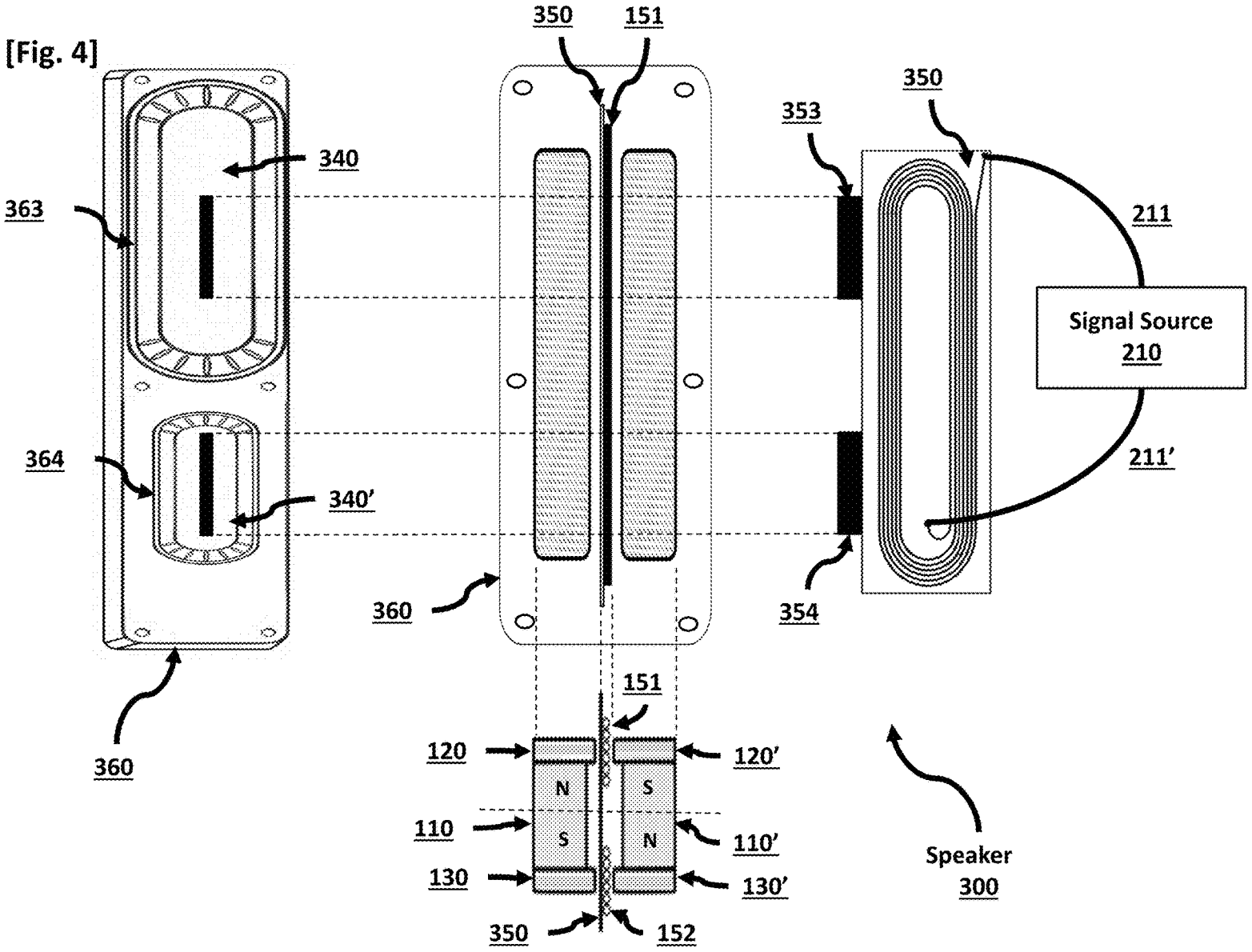
[Fig. 4]

[Fig. 5]
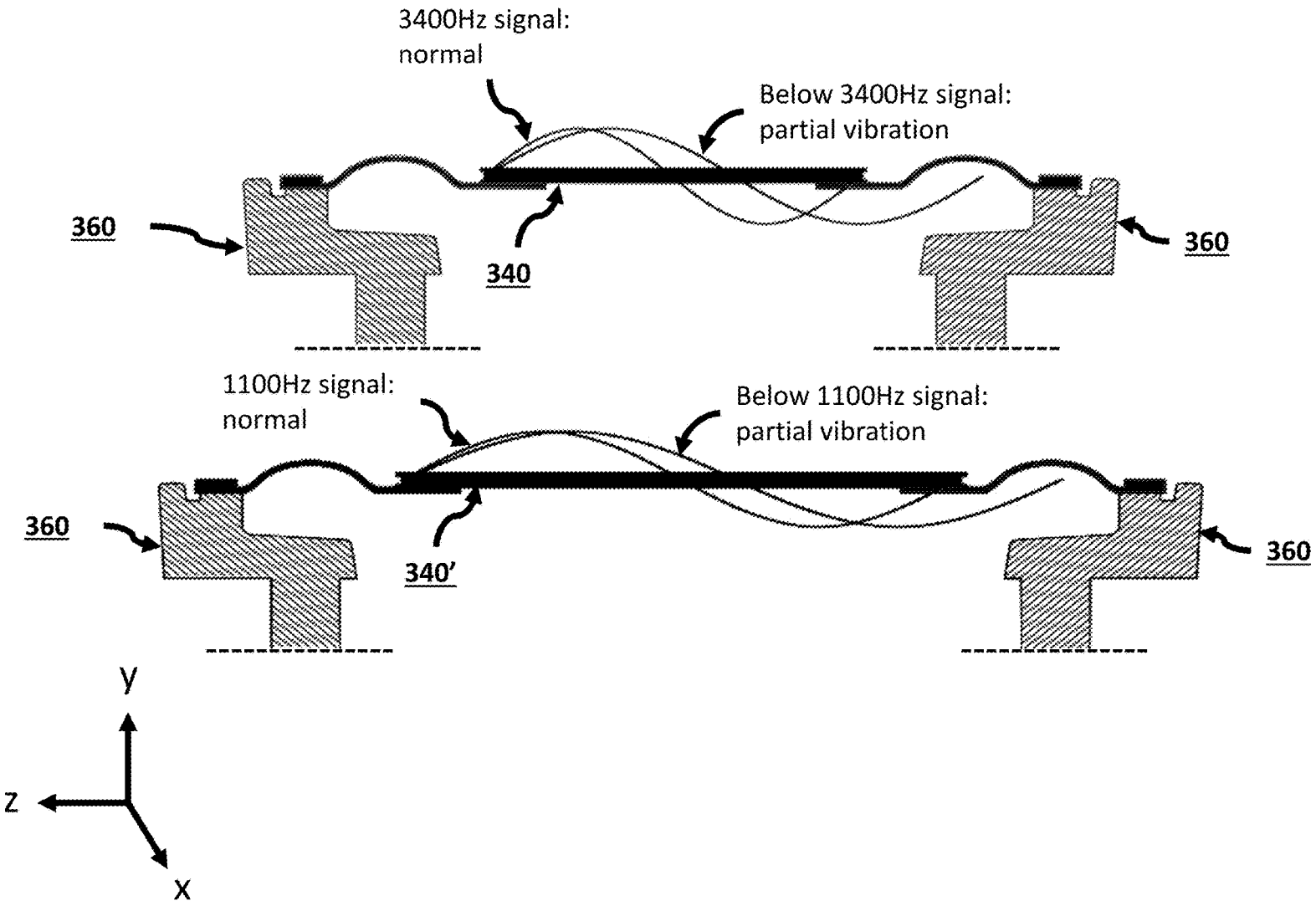

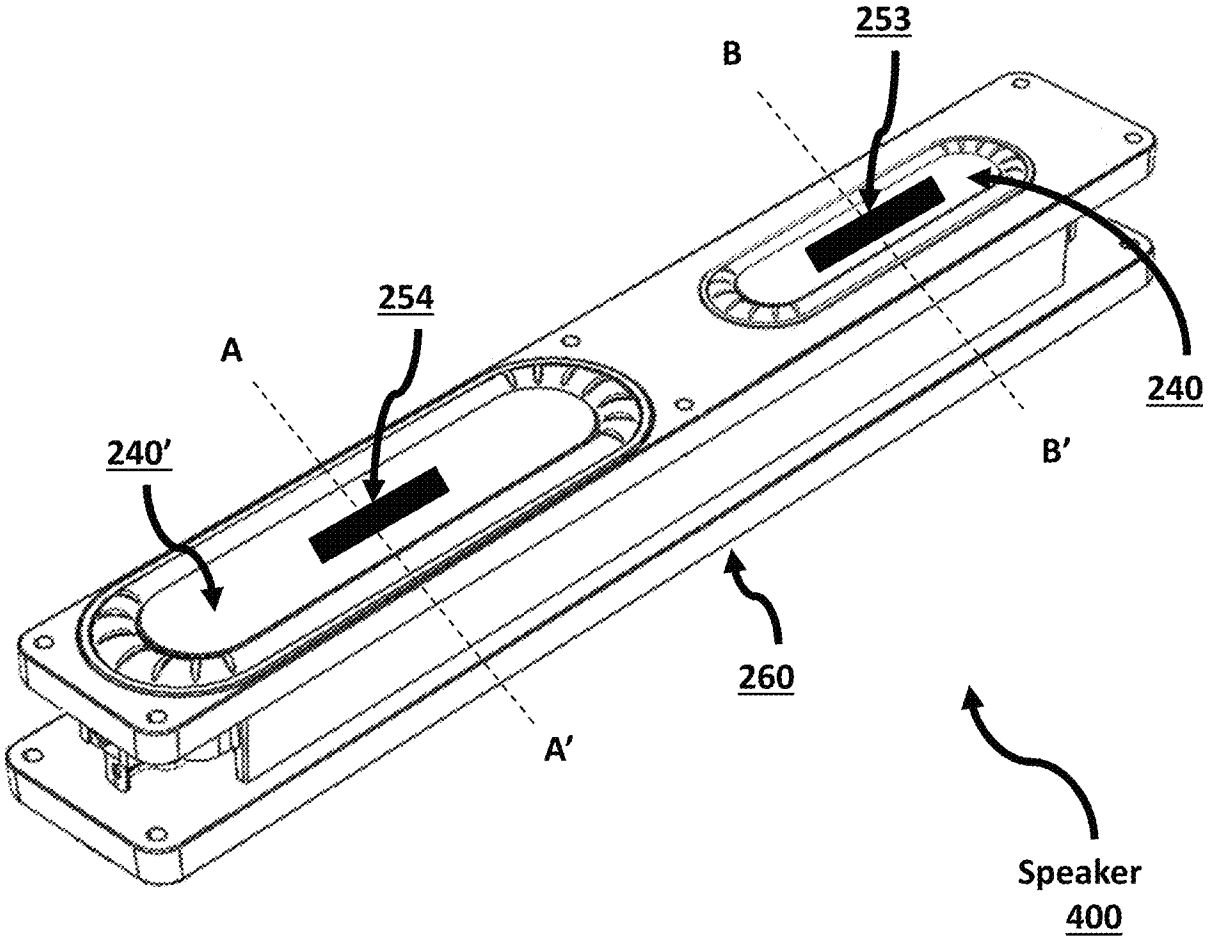
[Fig. 6a]

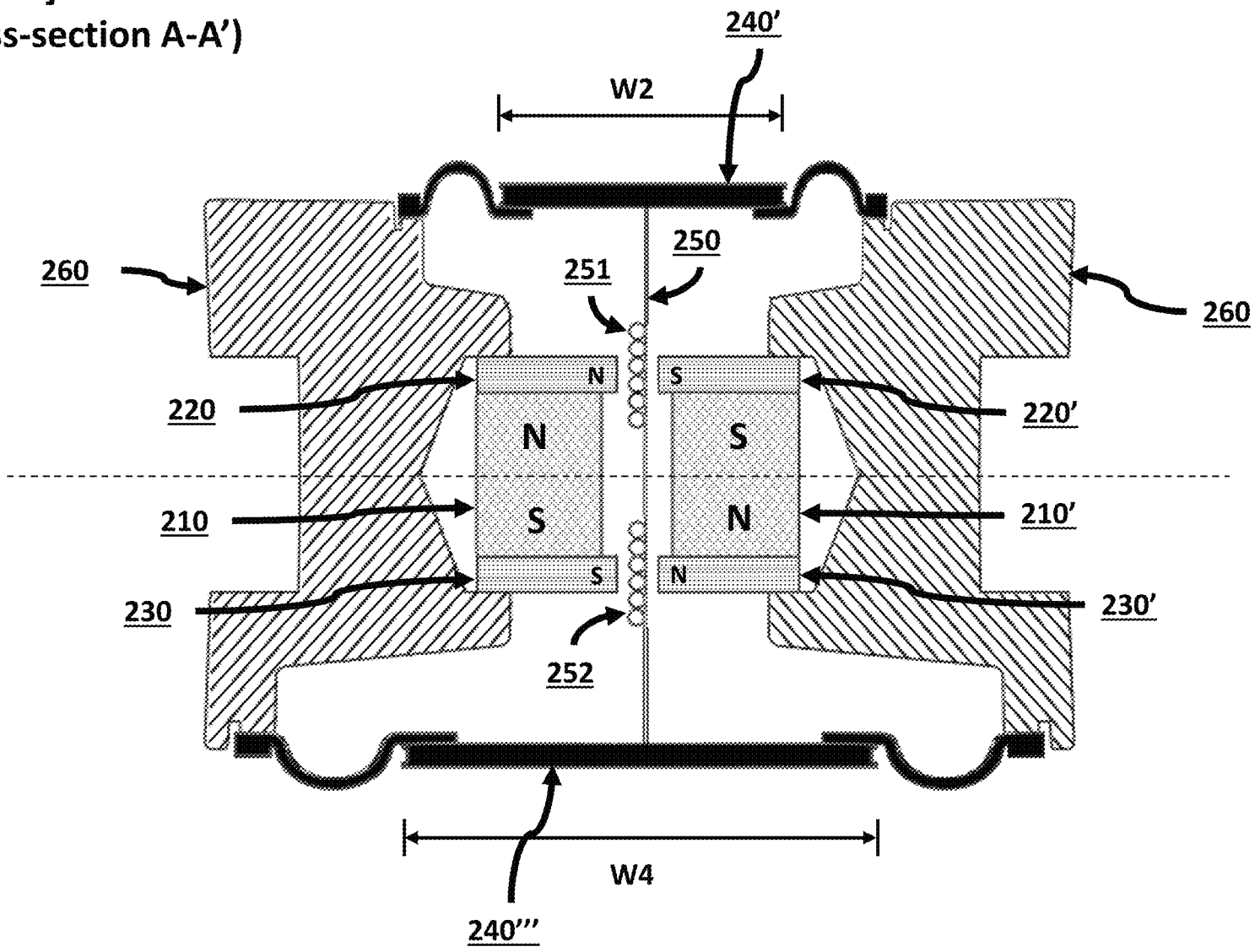
[Fig. 6b]
(cross-section A-A')

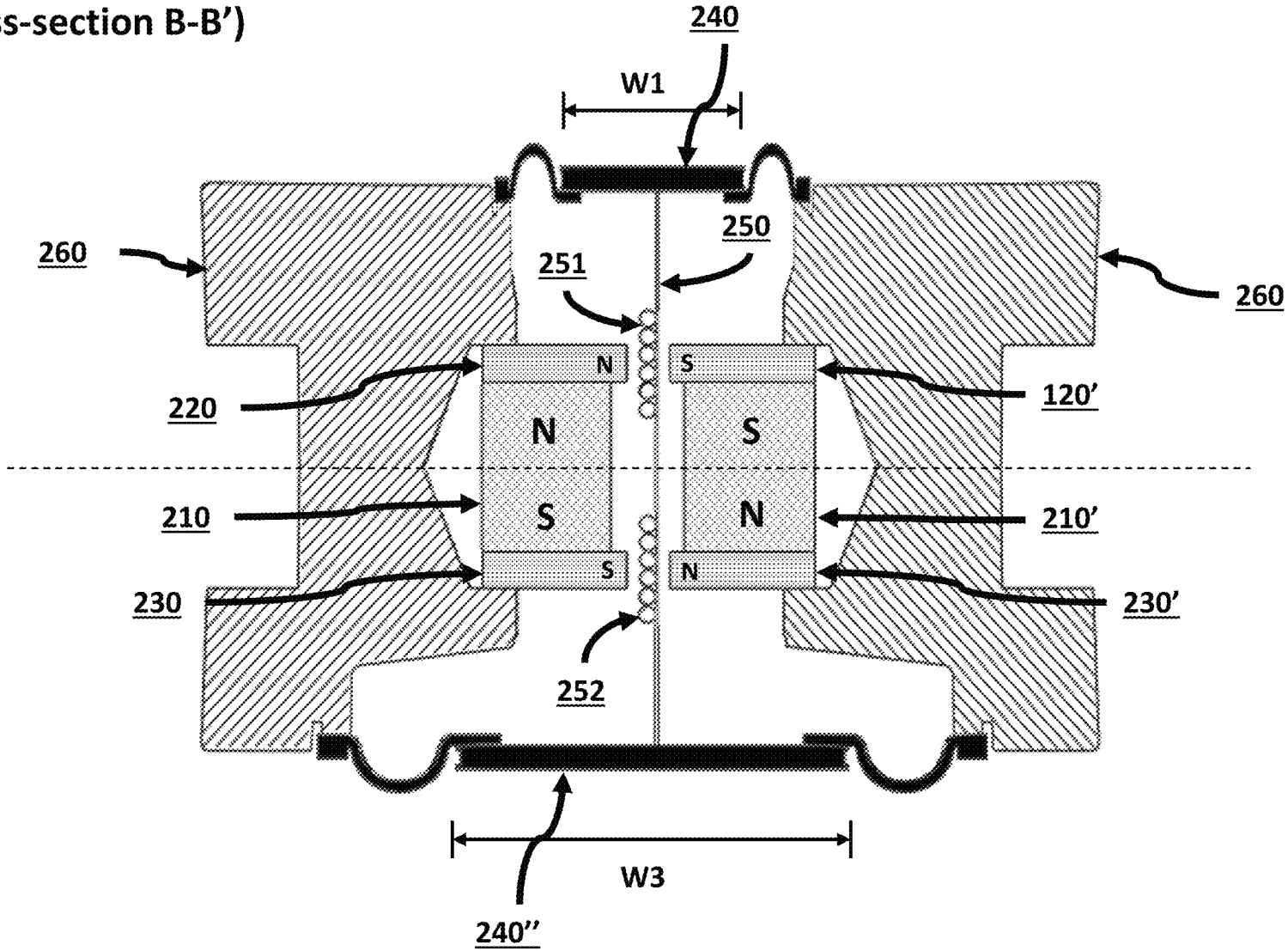
[Fig. 6c]
(cross-section B-B')

MULTI-RANGE SPEAKER CONTAINING MULTIPLE DIAPHRAGMS

PRIORITY CLAIM

This application is a continuation of U.S. patent application Ser. No. 16/659,389, filed on Oct. 21, 2019, and titled, "Multi-Range Speaker Containing Multiple Diaphragms," which claims priority to U.S. Provisional Patent Application No. 62/809,866, filed on Feb. 25, 2019, and titled, "A Speaker Capable of Producing a Multi-Range and Bidirectional Sound Using Bar Magnets," both of which are incorporated by reference herein.

TECHNICAL FIELD

Embodiments are disclosed of a speaker capable of producing multiple frequency ranges of sound. The speaker comprises bar magnets, multiple diaphragms, and one or more configurations of a coil-shaped conductor. Each configuration of coil-shaped conductor is located between bar magnets and translates a received electric signal into the kinetic energy that vibrates one or more diaphragms, where each diaphragm, if sized differently, is better suited to produce sound within a different range of frequencies. In some embodiments, the speaker generates bi-directional sound.

BACKGROUND OF THE INVENTION

A schematic illustration of commonly-used, prior art cone-type speaker 100 is shown in FIG. 1. Cone-type speaker 100 usually has a cylindrical shape and uses a cylindrical permanent magnet 10. Cone-type speaker 100 also comprises voice coil 11, diaphragm 12, basket/frame 13, and damper 14. Notably, because diaphragm 12 is cone-shaped, it has a significant height, which sets a limit on how thin the overall speaker structure can be. In addition, T-yoke 15 also has a significant height and sets a limit on how thin the overall speaker structure can be.

Moreover, the use of cylindrical magnet 10 forces the frame to adopt a closed-cone-shaped structure, which is, for practical consideration, limited from having multiple diaphragms driven by the same voice coil. The prior art also includes coaxial speakers, where multiple cone-shaped speakers are contained within a common structure, such as a tweeter being embedded within a woofer, but in those instances each speaker is driven by a separate voice coil and magnetic structure, and not the same voice coil and magnetic structure. Thus, in the prior art, the only multi-frequency range speakers that exist contain two separate speakers (with two diaphragms each driven by a separate voice coil and magnet) combined into one structure, which results in a more complicated structure and additional size and weight in the design.

Furthermore, in order to support the recent development of three-dimensional surround sound systems or other varieties of different sound reproduction that the industry requires, the speaker must be able to reproduce a broad range of sound signal with low distortion. The physical size of each diaphragm inherently limits the frequency range of sound that the diaphragm can produce effectively. A relatively small diaphragm is unable to reproduce low-frequency sound efficiently because the wavelength of the sound is larger than the diaphragm itself. On other hand, a relatively large diaphragm primarily designed to reproduce low-frequency sound may be ill-suited for reproducing high-frequency sound because larger prior art cone-shaped diaphragms often are not stiff enough to reproduce high-frequency sound without the occurrence of diaphragm breakup and modal behavior, resulting in significant distortion. The prior art lacks an efficient speaker structure that addresses both the spatial constraints and the requirement for a wide frequency range of sound. One prior art solution is to use multiple speakers of different frequency ranges set a certain distance apart from one another, but this method results in occupying an unnecessarily large space. Therefore, there exists a need for an improved speaker that can effectively reproduce a wide range of frequencies of sound but occupies less space than prior art speakers.

SUMMARY OF THE INVENTION

The invention solves the limitation of prior art speakers by providing speakers that efficiently produce sound at multiple frequency ranges through the use of differently-sized diaphragms while using less space than the space required for one prior art speaker. By using a larger proportion of the external surface of the speaker, the multi-diaphragm speaker of the present invention can achieve greater efficiency than a similarly-sized prior art speaker. The embodiments maintain an ultra-thin form and produce a broad range of frequencies. The embodiments also offer design options for improved directional control of the reproduced sound.

In multi-diaphragm embodiments of a speaker, multiple diaphragms are coupled to the same voice coil plate (also known as a bobbin) or a flexible printed circuit board (FPCB), or any other material means. This offers the opportunity to include any number of sound-producing surfaces above a single motor structure. These surfaces can have different surface areas, materials, and curvatures to achieve different frequency bands and dispersions. Optionally, the diaphragms can be co-planar or approximately co-planar. The distance between diaphragms can be varied to achieve different objectives. Moreover, each diaphragm may take on any shape including, but not limited to, circular, elliptical, rectangular, etc.

BRIEF DESCRIPTION OF THE DRAWINGS

Exemplary embodiments of the present invention are described with reference to the accompanying drawings, in which:

FIG. 1 depicts a conventional speaker with a cone-shaped structure.

FIG. 2 depicts an embodiment of a speaker comprising one diaphragm and a pair of bar magnets.

FIG. 3*a* depicts a cross-sectional embodiment of the voice coil plate of FIG. 2 viewed along the x-axis with current flowing in a first direction, as indicated by standard "dot and cross" notation.

FIG. 3*b* depicts a side-view of the voice coil plate viewed along the z-axis of FIG. 3*a*.

FIG. 3*c* is a schematic cross-sectional view of the voice coil plate of FIG. 3*a* with current flowing in the opposite direction, as indicated by standard "dot and cross" notation.

FIG. 3*d* depicts a side-view of the voice coil plate viewed along the z-axis of FIG. 3*c*.

FIG. 4 depicts a multi-view embodiment of a speaker that can generate multi-frequency-range sound using a bar magnet, multiple diaphragms, and a shared voice coil.

FIG. 5 shows the occurrence of partial vibration due to low frequency, long wavelength sound relative to the size of the diaphragm.

FIG. 6*a* is a three-dimensional partial view of a speaker that can generate multi-frequency range sound using a pair of bar magnets, multiple diaphragms, and a shared voice coil.

FIGS. 6*b* and 6*c* are cross section views along planes A-A' and B-B' illustrated in FIG. 6*a*, respectively.

DETAILED DESCRIPTION OF THE PREFERRED EMBODIMENT

Features and advantages of the present invention described above will become apparent from the following descriptions in conjunction with the accompanying drawings. According to the descriptions, a person with the proper technical expertise will be able to execute the technical idea illustrated in this present invention in the relevant industry. Since this invention can have a variety of different applications and may take different forms and shapes, only specific examples are illustrated through Figures and the detailed descriptions are found in the main text. However, this is by no means to restrict the present invention to the particular form disclosed; its derivations, equivalents, and substitutes must be understood as embracing all included in the scope of the present invention. The terms used herein are merely used to describe particular examples and are not intended to limit the present invention.

FIG. 2 depicts a speaker design utilizing a single diaphragm and a pair of bar magnets. Speaker 200 comprises bar magnets 110 and 110', upper magnetic yokes 120 and 120', lower magnetic yokes 130 and 130', diaphragm 140, and voice coil plate 150. Speaker 200 further comprises speaker frame 160. Bar magnets 110 and 110' comprise a pair of bar magnets that are positioned with a predetermined distance in between such that the different polarities are facing each other. On one end, voice coil plate 150 is secured to speaker frame 160 through diaphragm 140, and on the other end, voice coil plate 150 is secured to speaker frame 150 through a damper 170 or through a second diaphragm (not shown).

Upper magnetic yokes 120 and 120' are attached to the upper part of bar magnets 110 and 110' in the same plane, and lower magnetic yokes 130 and 130' are attached to the lower part of bar magnets 110 and 110' in the same plane. Upper magnetic yokes 120 and 120' and lower magnetic yokes 130 and 130' contain and direct the magnetic field in the area between the magnets where the voice coil resides. Upper magnetic yokes 120 and 120' and lower magnetic yokes 130 and 130' optionally may extend beyond bar magnets 110 and 110' into the magnetic gap to increase the magnetic flux density induced in the magnetic gap. Furthermore, magnetic yokes 120 and 120' optionally may comprise the same magnetic yoke, and magnetic yokes 130 and 130' optionally may comprise the same magnetic yoke.

Diaphragm 140 is positioned either above upper yokes 120 and 120' or below lower yokes 130 and 130'. In this case, diaphragm 140 must be configured to produce the corresponding frequency range sound accordingly with the size of diaphragm 140. In this embodiment, diaphragm 140 is substantially flat. However, diaphragm 140 instead could be convex or concave, or any shape with respect to the top surface of the frame designed for any application-related acoustic design.

FIG. 3*a*, FIG. 3*b*, FIG. 3*c*, and FIG. 3*d* taken from the context of FIG. 2 demonstrate the operation method of the speaker. Voice coil plate 150 must be positioned in a substantially rigid, planar form in the gap between bar magnets 110 and 110'. Coil 151/152 can be placed on one side of voice coil plate 150 or on both sides. Diaphragm 140 will be vibrated at a specific frequency range by the magnetic field induced by the pair of bar magnets 110 and 110' and the electric current flowing in the coil 151/152.

During operation, coil 151/152 receives an electrical audio signal from a signal source 210 over conductors 211 and 211'. A magnetic field is induced by bar magnets 110 and 110', generally in the direction from the north poles (N) to the south poles (S). During the first half of the signal cycle (defined as the "positive half-cycle"), current flows through coil 151 of FIG. 3*a* "out of the page", and current flows through coil 152 of FIG. 3*a* "into the page", according to the "dot and cross" standard convention for electrical current flowing through the plane of the page. This direction of current flow is shown from a different point of view in FIG. 3*b*. When the voice coil plate 150 and coupled voice coil 200 are installed in the context of FIG. 2, Lorentz forces are generated both by coil 151 interacting with the magnetic field between top magnetic yokes 120 and 120' and by coil 152 interacting with the magnetic field between bottom magnetic yokes 130 and 130', with the forces aligned in the same direction and pushing voice coil plate 150 upward, which pushes diaphragm 140 upward according to the magnitude of the electrical signal from the signal source. During the second half of the signal cycle (defined as the "negative half-cycle"), current flows through coil 151 of FIG. 3*c* "into the page", and current flows through coil 152 of FIG. 3*c* "out of the page", according to the standard "dot and cross" convention for electrical current flowing through the plane of the page. Since the direction of the current in both 151 and 152 of the voice coil is reversed, then the Lorentz forces from the interaction with the magnetic field between 120,120' and 130,130', respectively, will align in the same direction to push voice coil plate 150 downward, which pulls diaphragm 140 downward according to the magnitude of the electrical signal from the signal source.

In all embodiments of the speaker, both those already mentioned and to be mentioned later in this patent, each voice coil may be comprised of any electrically-conductive material, including but not limited to, any variant of copper wire, printed circuit board, flexible printed circuit board, or other conductive metal or alloy. A printed circuit board can comprise a plurality of layers, each of which comprises an etched coil. Two or more of the layers in the plurality of layers can be connected by one or more electrical vias to combine each layer's etched coil in series or parallel. Each of the layers can be attached to a control gate that can be turned on or off to alter the impedance of the speaker. A person of ordinary skill in the art will understand that a "via" is an electrical connection between layers of a board or an integrated circuit, and that a control gate used in this manner is acting as a switch.

Diaphragm 140 may be connected to frame 160 with connector 153 shown in FIG. 2, which can be made from a flexible material such as rubber, and which connects to diaphragm 140 and frame 160. Thus, the electric audio signal from the signal source is translated into kinetic energy to move diaphragm 140, reproducing sound.

FIG. 4 depicts speaker 300, which is a speaker capable of producing a multi-frequency range sound using bar magnets, multiple diaphragms, and a shared planar voice coil. FIG. 4 shows a top view, a cross-sectional top view, a cross-sectional view along a plane orthogonal to the magnetic gap (shown at the bottom of FIG. 4), and a view of the removed voice coil plate assembly (shown on the right side of FIG. 4) in relation to each other as indicated by the dashed lines. The proper placement of two diaphragms on a shared voice coil plate in FIG. 4 will result in the presentation of a speaker that can reproduce multi-frequency range sound.

Speaker 300 comprises certain components in common with speaker 200 in FIG. 2, namely, bar magnets 110 and 110', upper magnetic yokes 120 and 120', and lower magnetic yokes 130 and 130'. As in FIG. 3*b* and FIG. 3*d*, signal source 210 generates an electric audio signal that is provided to coil 151/152 over conductors 211 and 211'.

Speaker 300 further comprises diaphragm 340, diaphragm 340', voice coil plate 350, and speaker frame 360. That is, two or more diaphragms 340 and 340' substantially within the same plane are attached to the top side of voice coil plate 350. Optionally, this may be done using connectors 353 and 354, respectively. The resulting assembly is a multi-diaphragm speaker, reproducing different frequency ranges simultaneously, which allows for the reproduction of richer and more diverse audio as a result of this speaker structure capable of reproducing multi-range sound.

Bar magnets 110 and 110' are positioned a predetermined distance away from one another with different polarities facing each other. Upper magnetic yokes 120 and 120' are attached to the upper parts of bar magnets 110 and 110', and lower magnetic yokes 130 and 130' are attached to the lower parts of bar magnets 110 and 110'. Upper magnetic yokes 120 and 120' and lower magnetic yokes 130 and 130' are used to control the magnetic flux induced by bar magnets 110 and 110'. For this purpose, upper magnetic yokes 120 and 120' and lower magnetic yokes 130 and 130' have a larger width than bar magnets 110 and 110', thereby focusing the magnetic flux on coil 151/152. Optionally magnetic yokes 120 and 120' may be substantially the same piece in other embodiments of the invention, and optionally magnetic yokes 130 and 130' may be substantially the same piece in other embodiments of the invention.

A 1st diaphragm 340 is attached to voice coil plate 350 and positioned on the upper part of frame 360. A 2nd diaphragm 340' is positioned to be substantially co-planar with 1st diaphragm 340 and attached to voice coil plate 350. 1st diaphragm 340 and 2nd diaphragm 340' are both positioned on the upper portion of voice coil plate 350 and receive vibrational energy from voice coil 150 in response to electric current received within voice coil 151/152.

In this example, the sizes of 1st diaphragm 340 and 2nd diaphragm 340' are different, and 1st diaphragm 340 and 2nd diaphragm 340' therefore each reproduce a frequency range that is different than the frequency range reproduced by the other. The size of each diaphragm may be increased or decreased to produce either lower- or higher-frequency sound, determined roughly by the following equation:

$$f_0 = \frac{c}{d}$$

Where $f_0$=Cutoff Frequency

Where c=Speed of Sound in Air

Where d=Dimension of Diaphragm

For example, the 1st frequency range (which is the ideal frequency range of 1st diaphragm 340) can be made to be higher than the 2nd frequency range (which is the ideal frequency range of 2nd diaphragm 340') by making the size of 1st diaphragm 340 smaller than the size of 2nd diaphragm 340'. That is, as the size of a diaphragm gets smaller, the frequency range transmitted efficiently and accurately through that diaphragm will be made higher.

In the alternative, the frequency range of 1st diaphragm 340 can be made lower than the frequency range of 2nd diaphragm 340' by making the size of 1st diaphragm 340 larger than the size of 2nd diaphragm 340'. That is, as the size of a diaphragm gets larger, the ideal frequency range transmitted through that diaphragm efficiently and accurately will become lower.

Voice coil plate 350 is positioned within the space between bar magnets 110 and 110' in a plane that is perpendicular to the plane containing magnets 110 and 110', and one or more coils comprising elements 151 and 152 are coupled to one side or both sides of voice coil plate 350. 1st diaphragm 340 will vibrate effectively within the first frequency range and 2nd diaphragm 340' will vibrate effectively within the second frequency range in response to the Lorentz forces generated by the interaction of the electric current flowing through elements 151 and 152 comprising the voice coil and the magnetic field induced by the pair of bar magnets 110 and 110'.

Voice coil plate 350 can be connected to 1st and 2nd diaphragms 340 and 340'. Voice coil plate 350 optionally can extend from the plane containing 1st and 2nd diaphragms 340 and 340' to include connector 353 (the 1st junction) and connector 354 (the 2nd junction) connecting 1st diaphragm 340 and 2nd diaphragm 340' to voice coil plate 350, respectively. Connectors 353 and 354 allow vibrational energy generated by the Lorentz forces resulting from current in coils 151/152 interacting with the permanent magnetic field to effectively transfer to 1st and 2nd diaphragms 340 and 340'. In the standard top view of FIG. 4, these connectors are shown through diaphragms 340 and 340', despite the 1st junction and 2nd junction being located under diaphragms 340 and 340' in order to clarify their respective connection points under each diaphragm, as indicated by the dashed lines.

Optionally, 1st and 2nd diaphragms 340 and 340' can form part of the outside of a sealed speaker frame and can be connected directly to speaker frame 360 or can be connected indirectly through a connector such as connectors 363 and 364.

The Lorentz forces are generated in the same manner described previously for FIG. 2, except here voice coil plate 350 acts upon both diaphragms 340 and 340'.

FIG. 5 depicts the cause of partial vibration with respect to low and high frequency signals based on the size of the diaphragm. For example, assuming that the speed of sound is 340 m/s, if 1st diaphragm 340 is 10 cm wide in its maximum extent, then the first frequency range will be effectively 3400 Hz or higher. If the 2nd diaphragm 340' is 30 cm in its maximum extent, then the second frequency range will be approximately 1100 Hz or higher. As a result, 1st diaphragm 340 can successfully output signals with frequencies higher than 3400 Hz, but signals lower than 3400 Hz would cause partial vibration of 1st diaphragm 340 due to the wavelength of the audio signal being larger than the diaphragm itself. Similarly, 2nd diaphragm 340' can successfully output signals with frequencies higher than approximately 1100 Hz, but signals lower than approximately 1100 Hz would cause partial vibration of 2nd diaphragm 340' due to the wavelength of the audio signal produced being larger than the diaphragm itself. Partial vibrations of a diaphragm results in distorted sound and inaccurate reproduction of sound from signal source 210.

The sizes of 1st and 2nd diaphragms 340 and 340' can be described by their length along the x-axis and width along the z-axis. Also, the shapes of diaphragms 340 and 340' can be circular, elliptical, rectangular or any combination of these, and they can be flat, convex, or concave along the y-axis. In the example shown, 1st and 2nd diaphragms 340 and 340' are flat and have minimal height along the y-axis, which is a significant difference from diaphragm 12 in speaker 100, which allows speaker 300 to be thinner than speaker 100. These variations are optional and are made more practical to implement by the present invention.

As the sizes of diaphragms 340 and 340' increase along the x-axis and/or z-axis, the distance between diaphragms 340 and 340' can be increased or decreased as needed. The distance between diaphragms 140 and 140' can be determined based on the interference or distortion effect between the 1st and 2nd frequency ranges.

FIGS. 6*a*, 6*b*, and 6*c* contain detailed schematic illustrations of another practical example of a multi-frequency range speaker using bar magnets. Speaker 400 depicted in FIGS. 6*a*, 6*b*, and 6*c* contains multiple diaphragms at the top of the speaker and multiple diaphragms at the bottom of the speaker, which together can play at least 4 different frequency ranges. FIG. 6*a* is a three-dimensional partial view of speaker 400, and FIGS. 6*b* and 6*c* are cross sections along A-A' and B-B', respectively, of speaker 400 including different diaphragms.

Speaker 400 comprises a pair of bar magnets 210 and 210', top magnetic yokes 220 and 220', bottom magnetic yokes 230 and 230', diaphragms 240, 240', 240", and 240'", voice coil plate 250, and speaker frame 260. Optionally, speaker 400 further comprises connectors 253 and 254 that are extensions of voice coil plate 250 and are in contact with diaphragms 240 and 240', respectively, and similar connectors (not shown) that are extensions of voice coil plate 250 are in contact with diaphragms 240" and 240'". Bar magnets 210 and 210', top magnetic yokes 220 and 220', bottom magnetic yokes 230 and 230', and speaker frame 260 are equivalent to bar magnets 110 and 110', top magnetic yokes 120 and 120', bottom magnetic yokes 130 and 130', and speaker frame 160 and 360 in speakers 200 and 300 of FIGS. 2 and 3 and operate according to the same principles described previously as in FIGS. 2 and 3.

As depicted in FIGS. 6*a*, 6*b*, and 6*c*, diaphragms 240, 240', 240", and 240'" have widths of W1, W2, W3, and W4, respectively, which in this particular example are different from one another in this case such that W4>W3>W2>W1. The widths of diaphragms 240, 240', 240", and 240'" can be modified to suit different frequency ranges. Here, speaker 400 comprises four diaphragms, but it is to be understood that a smaller or larger number of diaphragms can be used.

For example, by increasing the sizes of diaphragms 240, 240', 240", and 240'", it is possible to decrease the 1st through 4th frequency ranges which allows the speaker to play wider ranges of frequencies compared to speaker 300 in FIG. 3. On the other hand, by decreasing the sizes of diaphragms 240, 240', 240", and 240'", it is possible to increase frequency ranges. In the examples depicted in FIGS. 6*a*, 6*b* and 6*c*, as the sizes of the 1st through 4th diaphragms (240, 240', 240", 240'") increase in order, the 1st through 4th frequency ranges decrease respectively. In this case, diaphragms 240, 240', 240", and 240'" are vibrated by the shared voice coil plate 250.

Here, one can control the signal to be outputted by the 1st diaphragm 240 if the incoming signal frequency is higher than the 1st frequency range, outputted by the 2nd diaphragm 240' if the incoming signal frequency is between the 1st and 2nd frequency ranges, outputted by the 3rd diaphragm 240" if the incoming signal frequency is between the 2nd and 3rd frequency ranges, or by the 4th diaphragm 240'" if the incoming signal frequency is lower than the 3rd frequency range.

On contrary, if the sizes of the 1st through 4th diaphragms 240, 240', 240", and 240'" decrease in order (in the opposite manner than shown in FIGS. 6*a*, 6*b*, and 6*c*), the 1st through 4th frequency ranges increase respectively. Here, one can control the signal to be outputted by the 1st diaphragm 240 if the incoming signal frequency is lower than the 2nd diaphragm's frequency range, outputted by the 2nd diaphragm 240' if the incoming signal frequency is between the 2nd and 3rd diaphragms' frequency ranges, outputted by the 3rd diaphragm 240" if the incoming signal frequency is between the 3rd and 4th diaphragms' frequency ranges, or outputted by the 4th diaphragm 240'" if the incoming signal frequency is higher than the 3rd frequency range.

The Lorentz forces are generated in the same manner described previously for FIG. 2, except here voice coil plate 250 acts upon diaphragms 240, 240', 240", and 240'".

According to the examples discussed before, unlike traditional speakers such as speaker 100, it is possible to realize rectangular shaped, flat speakers instead of circular, to simplify parts holding the voice coil plate and multiple diaphragms, to play multi-frequency range sounds at the same time by varying the sizes of diaphragms, and to play a wide range of sounds in general.

According to this invention, the output direction of the speaker can be controlled by changing the direction of current flowing in the voice coil plate and a multi-frequency range sound can be effectively played by having different sizes of diaphragms.

According to this invention, an enhancement in sound pressure level and ability to play multi-range sound while having an ultra-thin form can be achieved by placing differently sized diaphragms and adjusting the distances between the diaphragms.

This invention allows speakers to be ultra-light and ultra-thin which perfectly aligns with the demands for speakers used in thin and light objects.

The speaker proposed in this invention can effectively produce multi-range sounds by having multiple diaphragms with different sizes. The control signal determining the appropriate range of signal frequency and choosing appropriate diaphragm to output can be created by a controller or a processor. Such controller or processor responsible for creating control signals can be implemented by a combination of hardware and software.

In software implementation, not only the procedures and functions described in this document, but also each component and operation in this invention can be implemented using an appropriate programming language. Each software module is responsible for one or more procedures or functions described in this document. Implemented software codes can be stored in electronic memory and can be executed by a controller or processor.

Using this invention, by using an AC electrical signal to stimulate the voice coil(s), and by implementing differently-sized diaphragms which are coupled to the voice coil(s) and move accordingly, sound with a wide range of frequency can be reproduced efficiently. This type of speaker can be miniaturized and optimized to produce ideal sound output even in products that require an ultra-thin form factor. Also, the distance between the diaphragms can be determined to address any interference or distortion effects between the chosen frequency ranges for each diaphragm.

Several opportunities exist to use this technology across many industries. For example, automobiles, or even other types of vehicles such as boats, trains, and airplanes, may benefit from the ability to closely co-locate multiple frequency ranges in order to cover the entire audible spectrum effectively, all while maintaining an ultra-thin form factor. Furthermore, home IoT products could enjoy more effective coplanar integration of broadband sound produced by multiple diaphragms. Lastly, "hi-fi" home audio systems may benefit from new configurations offering options for more aesthetic design and flexibility with space considerations.

Another advantage offered by the embodiments is natural efficient broadband frequency coverage. Like in a conventional speaker, the frequency range capabilities of a speaker are heavily dependent on the surface area, shape, and material of the diaphragm. However, in conventional design, each speaker's surface must be designed separately to address different frequency ranges. This multi-diaphragm structure allows diaphragm surfaces with different lengths and widths to be included within the same speaker motor structure. By the nature of their direct attachment by glue or another method to the voice coil, they can be designed to be coplanar, or otherwise similarly powered, in-phase surfaces. Yet, these surfaces are designed differently and are all powered by the motion of one magnet-and-voice-coil motor structure.

Yet another advantage offered by the embodiments is cooperative variation of surface design. Conventional sound systems often implement different speaker drivers with different surface materials to achieve different properties. These speakers are installed as separate components in such a way that they can cooperate to achieve a higher overall sound quality than the parts alone. However, the limitation is that in order to use these different materials, multiple speaker drivers must be used. There are a few design variations which exist, for example, dust cap design and multiaxial speakers, but they still include multiple electromechanical motors for different speakers within their structure. With the present invention, to improve upon the original speaker structure, these multiple diaphragms may be implemented with different materials and different curvatures in addition to their configuration and attachment to the voice coil plate. One surface, for example, might be designed as a soft-dome tweeter while another is designed from a stiff material for a subwoofer. Additionally, the materials and arrangement of the various surfaces may be construed to affect the center of mass of the moving parts alone, or the overall system.

A final advantage offered by the embodiments is control of sound directivity. The end use of a speaker often demands a specific type of directivity, such as a wide dispersion, a narrow dispersion, or something in between. The surface orientation and curvature can offer better control over the directivity of the sound, whether the goal is to focus the sound in one particular direction or broaden its dispersion.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, for example, data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A speaker comprising:

a first bar magnet comprising a north pole and a south pole;

a second bar magnet comprising a north pole and a south pole, the second bar magnet located a predefined distance from and parallel to the first bar magnet with the north pole of the second bar magnet facing the south pole of the first bar magnet and the south pole of the second bar magnet facing the north pole of the first bar magnet;

a voice coil plate located between the first bar magnet and the second bar magnet, the voice coil plate comprising a coil for receiving an electrical signal;

a first diaphragm attached to a first end of the voice coil plate by a first connector;

a second diaphragm attached to the first end of the voice coil plate by a second connector;

a third diaphragm attached to a second end of the voice coil plate by a third connector; and a fourth diaphragm attached to the second end of the voice coil plate by a fourth connector;

wherein the voice coil plate vibrates the first diaphragm, the second diaphragm, the third diaphragm, and the fourth diaphragm in response to force generated by the electrical signal in the coils and a magnetic field between the first bar magnet and the second bar magnet.

2. The speaker of claim 1, wherein the first diaphragm, the second diaphragm, the third diaphragm, and the fourth diaphragm are of different sizes.

3. The speaker of claim 1, wherein the first diaphragm is capable of reproducing sound within a first frequency range, the second diaphragm is capable of reproducing sound within a second frequency range, the third diaphragm is capable of reproducing sound within a third frequency range, and the fourth diaphragm is capable of reproducing sound within a fourth frequency range; and wherein the first frequency range, the second frequency range, the third frequency range, and the fourth frequency range are different ranges.

4. The speaker of claim 3, wherein the first diaphragm, the second diaphragm, the third diaphragm, and the fourth diaphragm are of different sizes.

5. The speaker of claim 1, further comprising:

a first magnetic yoke attached to a first side of the first bar magnet;

a second magnetic yoke attached to a first side of the second bar magnet;

a third magnetic yoke attached to a second side of the first bar magnet; and a fourth magnetic yoke attached to a second side of the second bar magnet.

6. The speaker of claim 5, wherein the first diaphragm, the second diaphragm, the third diaphragm, and the fourth diaphragm are of different sizes.

7. The speaker of claim 1, further comprising:

a frame which may enclose the speaker.

8. The speaker of claim 7, wherein the first diaphragm, the second diaphragm, the third diaphragm, and the fourth diaphragm are of different sizes.

9. The speaker of claim 1, wherein a wound coil of wire is attached to one or both sides of the voice coil plate.

10. The speaker of claim 9, wherein the first diaphragm, the second diaphragm, the third diaphragm, and the fourth diaphragm are of different sizes.

11. The speaker of claim 1, wherein the voice coil plate comprises a printed circuit board which comprises an etched coil, wherein the etched coil is etched into a plurality of layers within the printed circuit board.

12. The speaker of claim 11, wherein the first diaphragm, the second diaphragm, the third diaphragm, and the fourth diaphragm are of different sizes.

13. The speaker of claim 11, wherein two or more of the layers in the plurality of layers are connected by one or more vias to combine each layer's etched coil in series or parallel.

14. The speaker of claim 13, wherein the first diaphragm, the second diaphragm, the third diaphragm, and the fourth diaphragm are of different sizes.

15. The speaker of claim 13, wherein one or more vias are attached to control gates that can be turned on or turned off to alter the impedance of the speaker.

16. The speaker of claim 15, wherein the first diaphragm, the second diaphragm, the third diaphragm, and the fourth diaphragm are of different sizes.

* * * * *